US010582296B1

(12) United States Patent
VanSickel et al.

(10) Patent No.: US 10,582,296 B1
(45) Date of Patent: Mar. 3, 2020

(54) FOLDABLE SPEAKER BAFFLE SYSTEM

(71) Applicant: Audio Accessories Group, LLC, Tempe, AZ (US)

(72) Inventors: Larry VanSickel, Phoenix, AZ (US); Wang Hai, Ningbo (CN); Gu Wendong, Ningbo (CN); Zhou Liang, Ningbo (CN)

( * ) Notice: Subject to any disclaimer, the term of this patent is extended or adjusted under 35 U.S.C. 154(b) by 0 days.

(21) Appl. No.: 15/910,391

(22) Filed: Mar. 2, 2018

(51) Int. Cl.
*H04R 1/28* (2006.01)

(52) U.S. Cl.
CPC ..... *H04R 1/288* (2013.01)

(58) Field of Classification Search
CPC ..... H04R 1/2876; H04R 1/2869; H04R 1/28
See application file for complete search history.

(56) References Cited

U.S. PATENT DOCUMENTS 6,505,705 B1 * 1/2003 Espiritu ..... H04R 1/025 181/150
6,545,948 B1 * 4/2003 Jiang ..... H04R 1/44 367/165
6,843,345 B2 * 1/2005 Koizumi ..... B60R 11/0217 181/150
8,739,921 B1 6/2014 Lardon
2004/0051445 A1 * 3/2004 Adachi ..... G02B 5/3016 313/504
2007/0039777 A1 * 2/2007 Whitaker ..... H04R 1/025 181/150
2011/0123061 A1 * 5/2011 Kamimura ..... H04R 9/025 381/412
2012/0195455 A1 * 8/2012 Chiba ..... H04R 1/1091 381/374
2014/0348349 A1 * 11/2014 Nagaoka ..... H04R 1/288 381/162

* cited by examiner

*Primary Examiner* — Tuan D Nguyen
(74) *Attorney, Agent, or Firm* — Keith L. Jenkins, Registered Patent Attorney, LLC; Keith L. Jenkins

(57) ABSTRACT

The invention includes a one-piece foldable flexible foam baffle that can be adapted in length to installation plenums of various sizes, together with an egg crate foam type rear damper and a gasket for attaching the foldable baffle to a loudspeaker basket rim. A front portion and a rear portion of the foldable baffle are independently foldable to adjust the length of the foldable baffle for various door plenums and trim panel offsets. The baffle has small axial grooves on a rear portion that serve as auxiliary cutting lines as a guide for cutting away portions of the baffle to manage the back wave of the speaker in ways an audiophile prefers.

20 Claims, 11 Drawing Sheets

FOLDABLE SPEAKER BAFFLE SYSTEM

FIELD OF ART

The present invention relates to speaker baffles, primarily for automotive loudspeaker installations. The present invention more particularly relates to a one-piece foldable flexible foam baffle that can be adapted to installation cavities of various sizes, together with an egg crate foam type rear damper and a gasket for attaching to a loudspeaker basket rim.

BACKGROUND OF THE INVENTION

Installation of loudspeakers in vehicles presents challenges, including adapting to space limitations and controlling echoes in installation cavities. Several types of speaker baffles have been developed but have various limitations. An automotive audio is a sound playing apparatus disposed to provide entertainment for a driver and a passenger during a trip. A loudspeaker, as a player element of the automotive audio, is usually mounted in an automotive door by using a baffle, and the baffle is covered by an interior trim panel on the door. However, there is a relatively big difference between thickness dimensions of existing automotive doors. Therefore, it is difficult for the baffle, used to help the loudspeaker be mounted in the door, to form a uniform standard size. In a conventional approach, the baffle is directly mounted in a mounting hole of the door. As a result, a case in which a size of a rear portion of the baffle is difficult to match in the door always occurs. If the size of the rear portion is relatively long, the acoustic relationship between the loudspeaker and the door may be affected. If the size of the rear portion is relatively short, the loudspeaker is not well protected. In addition, a front portion of the baffle also has a dimension thickness. If a size of the front portion is excessively long, a crossed reflex of sound between the loudspeaker and the door occurs, affecting the sound quality of play.

SUMMARY OF THE INVENTION

Briefly described, the invention includes a one-piece foldable flexible foam baffle that can be adapted in length to installation cavities of various sizes, together with an egg crate foam type rear damper and a gasket for attaching the baffle to a loudspeaker basket rim. The baffle has small axial grooves on a rear portion that serve as auxiliary cutting lines as a guide for cutting away portions of the baffle to manage the back wave of the speaker in ways an audiophile prefers.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 1:
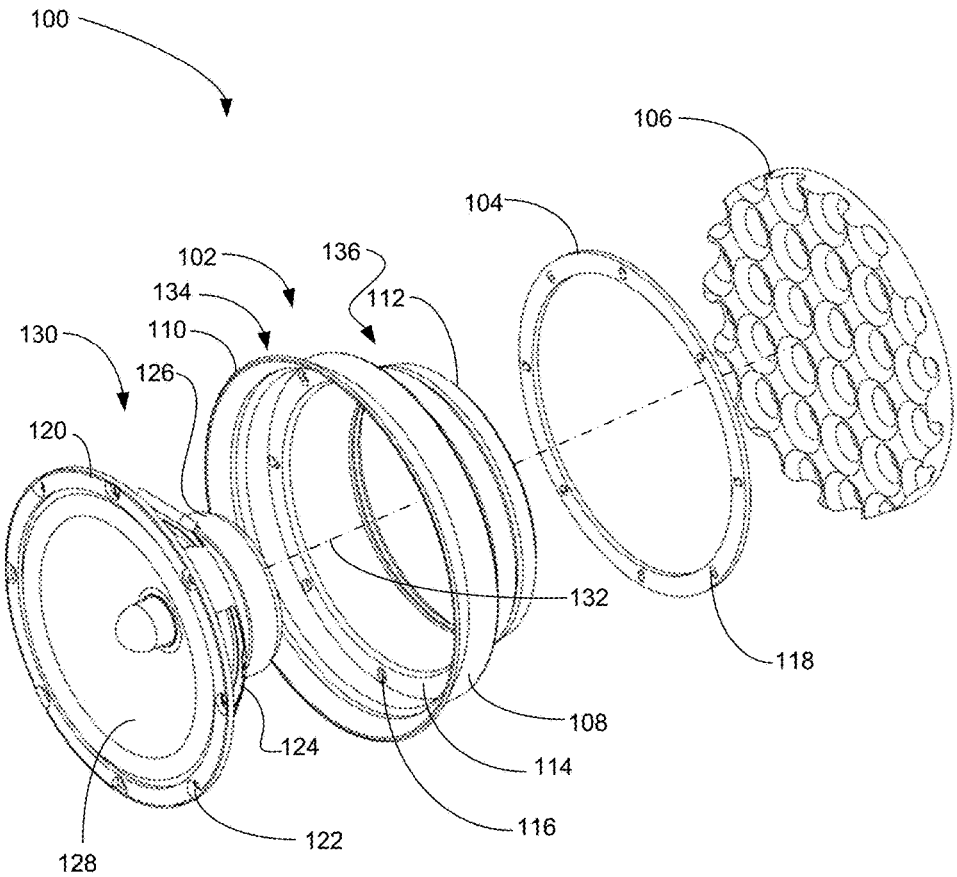
FIG. 1 is an exploded perspective view illustrating an exemplary embodiment of the foldable speaker baffle system, according to a preferred embodiment of the present invention.

As used and defined herein, "speaker" means "loudspeaker". Referential directions such as "top" and "bottom", are referred to the drawing, while "front", and "rear" are referred to the operational orientation of the present invention.

FIG. 1 is an exploded perspective view illustrating an exemplary embodiment of the foldable speaker baffle system 100, according to a preferred embodiment of the present invention. Foldable speaker baffle 102 is made of flexible, acoustically-dampening, soft silicone rubber and includes a front edge 110, a rear edge 112, a main conical ring 108 there between, and an annular attachment panel 114 with baffle fastener openings 116. The annular attachment panel 114 divides the foldable speaker baffle 102 into a foldable front portion 134 and an independently foldable rear portion 136. Taken all together, the foldable speaker baffle 102 is a shell of revolution about central axis 132. Baffle fastener openings 116 align with rim fastener openings 122 on speaker basket rim 120 of speaker 130. Speaker 130 has a basket 124 that supports speaker basket rim 120 and magnet 126. Diaphragm 128 is supported by a surround clamped to the basket 124 by the speaker basket rim 120. Baffle fastener openings 116 also align with gasket fastener openings 118 in gasket 104. Sound dampening pad 106 is installed on the rear wall 210 of the door plenum 218 (see FIG. 2) to avoid reflecting sound off the rear wall 210. Installation of the sound dampening pad 106 is preferably with adhesive. In a particular embodiment, the sound dampening pad 106 includes an adhesive back layer with a release layer for storage and shipping. Sound dampening pad 106 is preferably an egg crate shaped foam sound damper and preferably is of a different type of material than foldable speaker baffle 102. Sound dampening pad 106 may be of various diameters in various respective embodiments. Using the soft silicone not only ensures waterproof performance and anti-corrosion performance, and effectively prolongs service life of a related component such as a loudspeaker 130, but also can better reduce noise that is generated due to vibration between the loudspeaker 130 and assemblies such as the door panel 206 (see FIG. 2) and an in-vehicle metal plate.

Figure 2A:
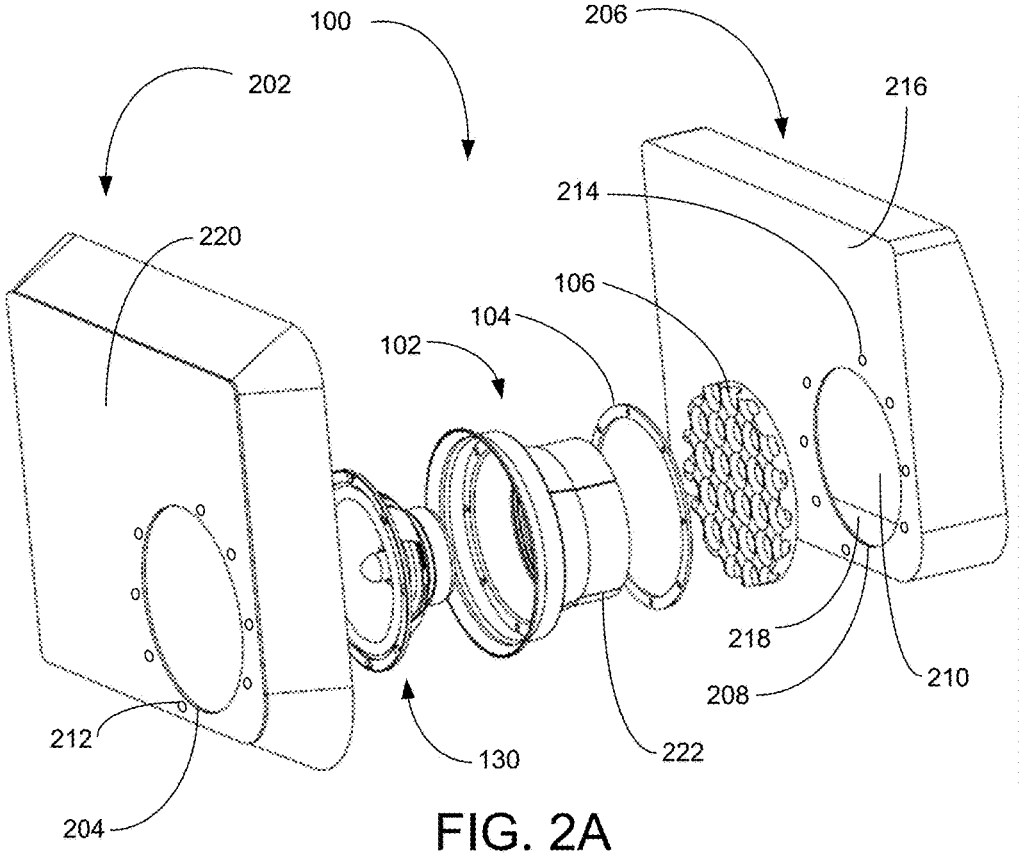
FIG. 2A is exploded perspective view illustrating an exemplary embodiment of the foldable speaker baffle system of FIG. 1 with exemplary vehicle door and trim panel, according to a preferred embodiment of the present invention.

FIG. 2A is exploded perspective view illustrating an exemplary embodiment of the foldable speaker baffle system 100 of FIG. 1 with exemplary vehicle door panel 206 and trim panel 202, according to a preferred embodiment of the present invention. Door panel 206 has a rear wall 210 and forms a door plenum 218 accessed via door panel opening 208. In installation, sound dampening pad 106 is attached to rear wall 210. Fasteners through speaker rim openings 122, baffle fastener openings 116, gasket fastener openings 118, and door plenum fastener openings 214, secure the speaker 130 and foldable speaker baffle 102 to the front wall 216 of door panel 206 through door panel opening 208. Trim panel 202 covers front wall 216 of door panel 206. Trim panel opening 204 on trim panel front wall 220 aligns to door panel opening 208 and allows the front sound wave 1006 (see FIG. 10) to project into the vehicle. In this installation, foldable speaker baffle 102 maybe folded, as will be described further below. Trim panel fastener openings 212 are used to support a speaker grill (not shown). In yet another embodiment, there are no trim panel fastener openings 212. Auxiliary cutting lines 222 (one of two visible labeled of four) are axially aligned on the rear portion 136 of foldable speaker baffle 102 and arranged about the circumference at ninety degree intervals.

Figure 2B:
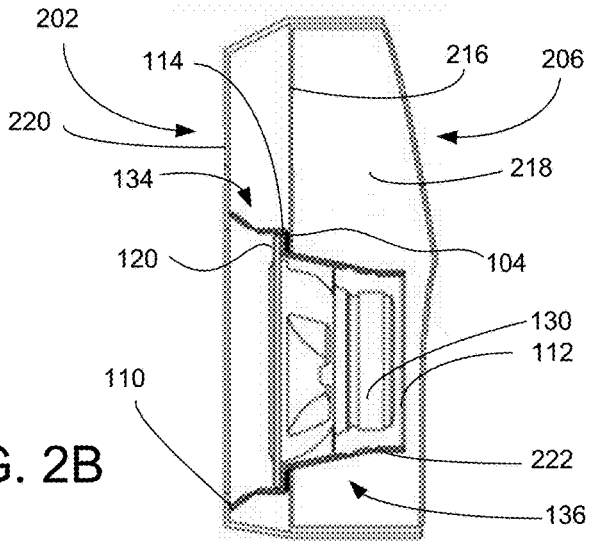
FIG. 2B is side elevation cross sectional view illustrating an exemplary embodiment of the foldable speaker baffle system of FIG. 1 with exemplary vehicle door panel and trim panel, according to a preferred embodiment of the present invention.

FIG. 2B is side elevation cross sectional view illustrating an exemplary embodiment of the foldable speaker baffle system 100 of FIG. 1 with exemplary vehicle door panel 206 and trim panel 202, according to a preferred embodiment of the present invention. Front portion 134 of foldable speaker baffle 102 is disposed between front wall 216 of door panel 206 and trim panel front wall 220. Gasket 104 is positioned between annular attachment panel 114 and front wall 216. In another embodiment, gasket 104 extends around the edge of door panel opening 208 to protect the soft silicone rubber of the foldable speaker baffle 102 from the effects of vibrations of the sharp edge corners of the door panel opening 208. Front edge of foldable speaker baffle 102 abuts the interior side of trim panel front wall 220, as shown.

Figure 3:
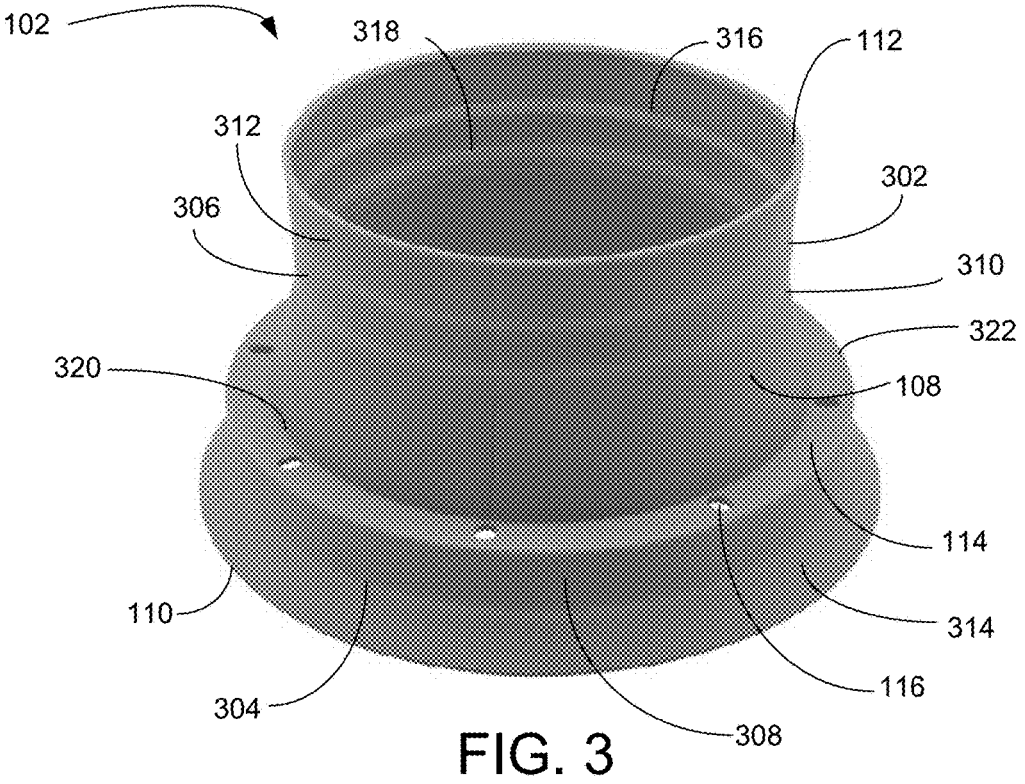
FIG. 3 is a rear-side perspective view illustrating an exemplary embodiment of the foldable speaker baffle of the exemplary foldable speaker baffle system of FIG. 1, according to a preferred embodiment of the present invention.

FIG. 3 is a rear-side perspective view illustrating an exemplary embodiment of the foldable speaker baffle 102 of the exemplary foldable speaker baffle system 100 of FIG. 1, according to a preferred embodiment of the present invention. Foldable speaker baffle 102 is illustrated in an unfolded configuration. First cylindrical ring 312 has a rear edge 112 and first fold line 302 between first cylindrical ring 312 and second cylindrical ring 306. First fold line 302 includes a triangular groove 316 on the interior side. First cylindrical ring 312 may fold inward along first fold line 302 to abut second cylindrical ring 306. Second cylindrical ring 306 extends axially between first fold line 302 and second fold line 310 to connect with the narrow end of the truncated cone of main conical ring 108. Second fold line 310 includes a triangular groove 318 on the interior side. Main conical ring 108 extends axially forward from second fold line 310 to an inner edge 320 of annular attachment panel 114 which is in planes transverse to the central axis 132 of the foldable speaker baffle 102. Third cylindrical ring 308 extends axially forward from an outer edge 322 of annular attachment panel 114 to third fold line 304. Forward conical ring 314 extends axially forward from third fold line 304 to front edge 110. Foldable speaker baffle 102 is of one piece of molded silicone rubber and is a shell of revolution about a central axis 132. In another embodiment, second cylindrical ring 306 may be conical.

Figure 4:
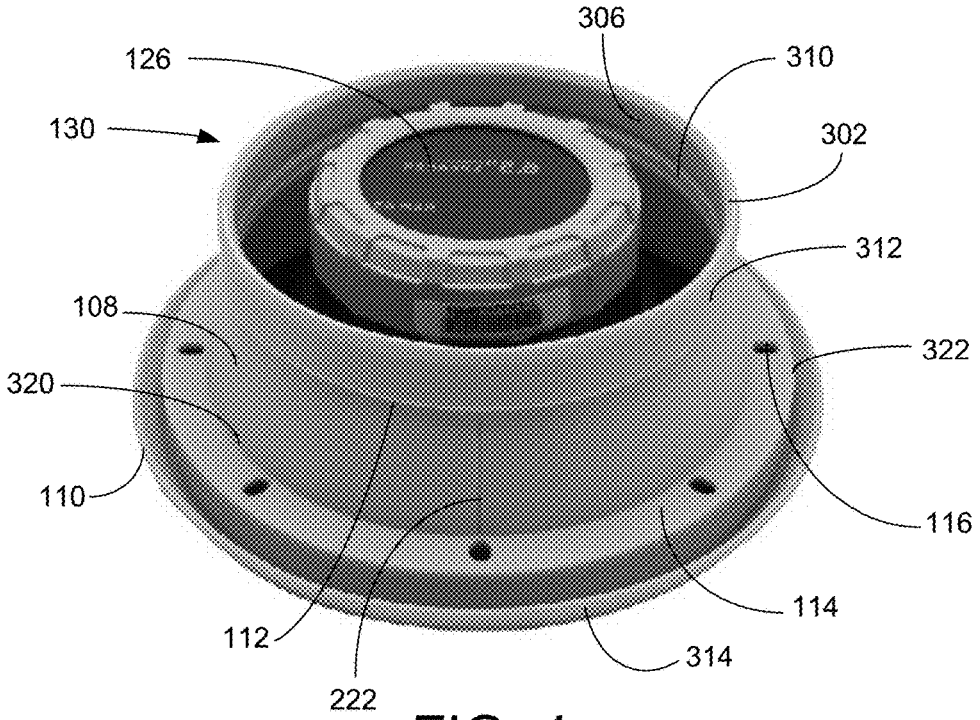
FIG. 4 is a rear-side perspective view illustrating an exemplary embodiment of the foldable speaker baffle of FIG. 1 of the exemplary foldable speaker baffle system of FIG. 1, according to a preferred embodiment of the present invention.

FIG. 4 is a rear-side perspective view illustrating an exemplary embodiment of the foldable speaker baffle 102 of FIG. 1 of the exemplary foldable speaker baffle system 100 of FIG. 1, according to a preferred embodiment of the present invention. Foldable speaker baffle 102 is illustrated in a completely folded configuration and with a speaker 130 installed. First cylindrical ring 312 is folded along first fold line 302 outward and downward to cover second cylindrical ring 306. Forward conical ring 314 is folded outward and rearward along third fold line 304 to cover third cylindrical ring 308. First cylindrical ring 312 is folded outward and forward along first fold line 302 to cover second cylindrical ring 306. The foldable speaker baffle 102 is thus folded to match the dimensions of the speaker 130 and the door plenum 218.

Figure 5:
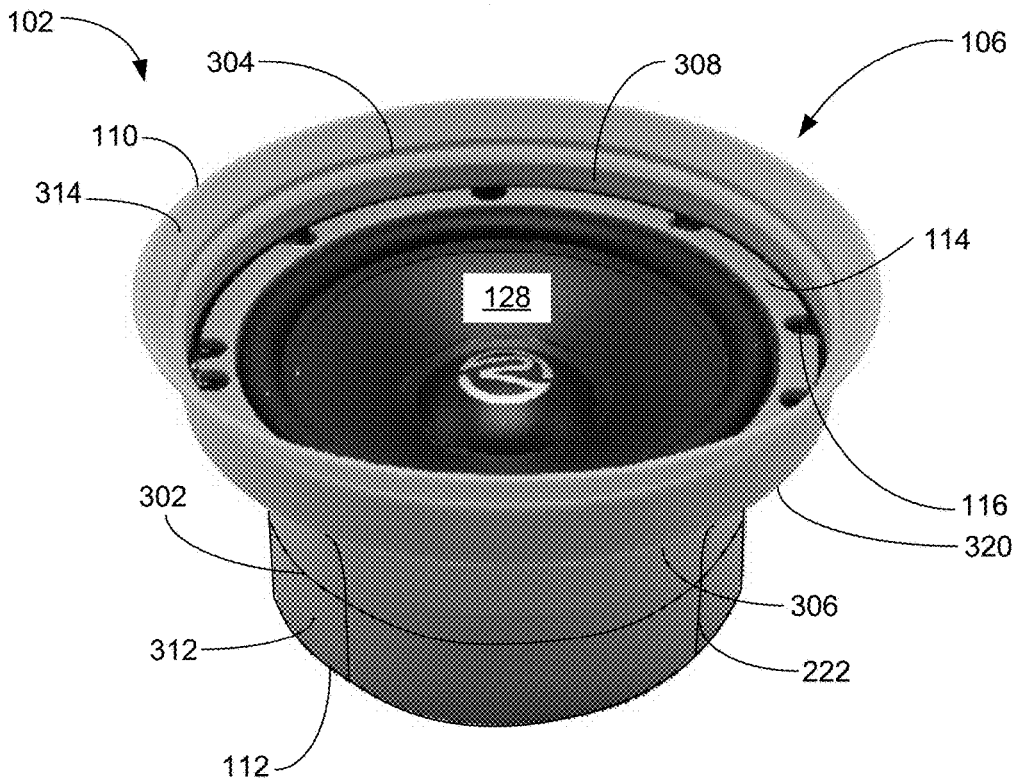
FIG. 5 is a top-side perspective view illustrating an exemplary embodiment of the foldable speaker baffle 102 of FIG. 1 of the exemplary foldable speaker baffle system of FIG. 1, according to a preferred embodiment of the present invention.

FIG. 5 is a top-side perspective view illustrating the exemplary embodiment of the foldable speaker baffle 102 of FIG. 1 of the exemplary foldable speaker baffle system 100 of FIG. 1, according to a preferred embodiment of the present invention. Foldable speaker baffle 102 is shown in an unfolded configuration with speaker 130 positioned there within.

Figure 6:
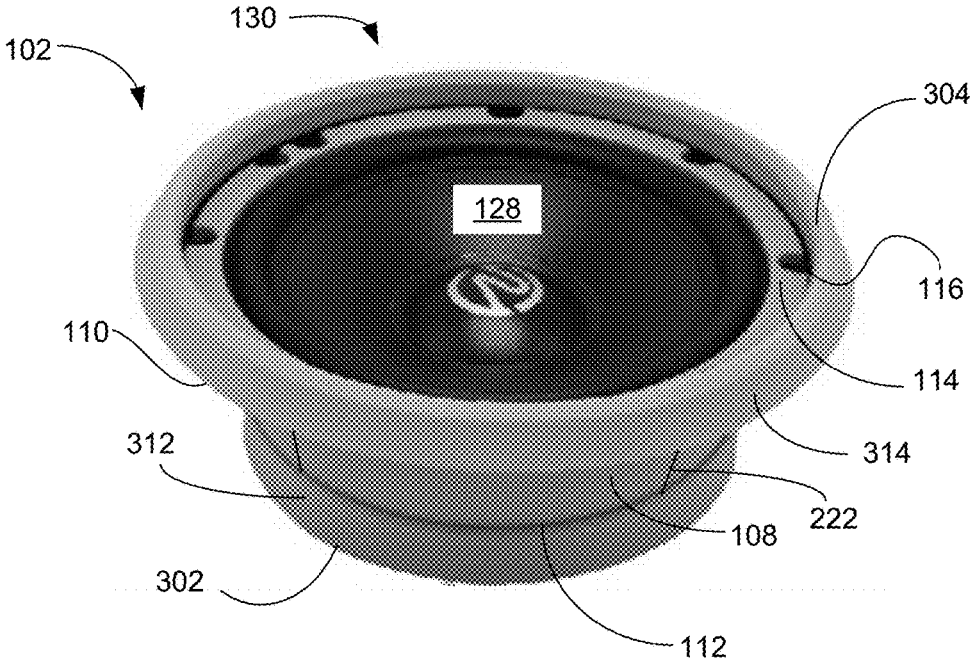
FIG. 6 is a top-side perspective view illustrating an exemplary embodiment of the exemplary foldable speaker baffle system of FIG. 1, according to a preferred embodiment of the present invention.

FIG. 6 is a front-side perspective view illustrating an exemplary embodiment of the foldable speaker baffle 102 of FIG. 1 of the exemplary foldable speaker baffle system 100 of FIG. 1, according to a preferred embodiment of the present invention. Foldable speaker baffle 102 is shown in a completely folded configuration with speaker 130 positioned there within. Foldable speaker baffle 102 is folded as described in regard to FIG. 3.

Figure 7B:
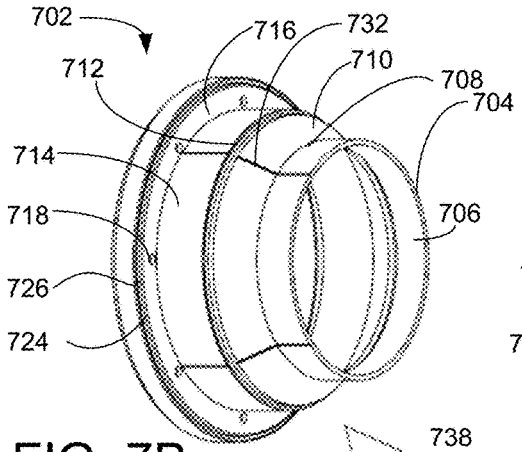
FIG. 7B is a rear perspective view illustrating the second exemplary embodiment of the baffle of FIG. 7A for the exemplary foldable speaker baffle system of FIG. 1 in a first folded configuration, according to a preferred embodiment of the present invention.
Figure 7C:
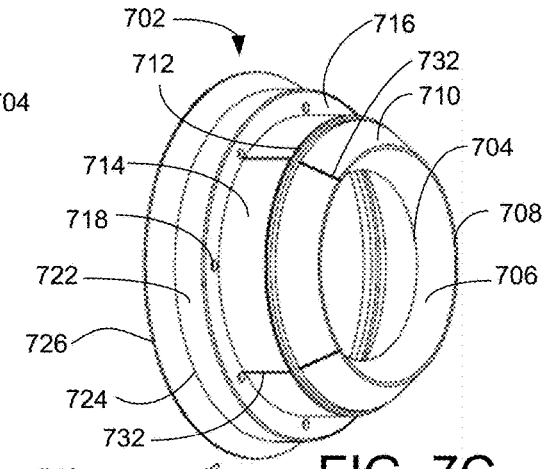
FIG. 7C is a rear perspective view illustrating the second exemplary embodiment of the baffle of FIG. 7A for the exemplary foldable speaker baffle system of FIG. 1 in a second folded configuration, according to a preferred embodiment of the present invention.
Figure 7A:
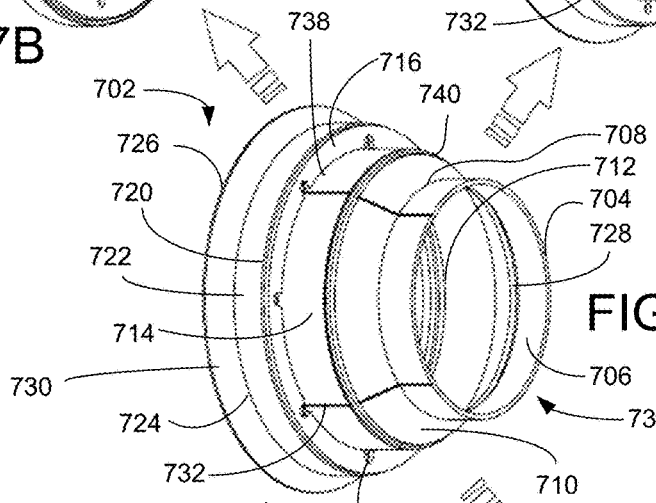
FIG. 7A is a rear perspective view illustrating a second exemplary embodiment of a baffle for foldable speaker baffle system of FIG. 1, according to a preferred embodiment of the present invention.

FIG. 7A is a rear perspective view illustrating a second exemplary embodiment of a foldable speaker baffle 702 for foldable speaker baffle system 100 of FIG. 1, according to a preferred embodiment of the present invention. Foldable speaker baffle 702 is preferably one piece of molded silicone and is, like foldable speaker baffle 102, a shell of revolution about a central axis 132. Rear ring 706 extends axially forward from rear edge 704 to first fold line 708. First fold line 708 includes a triangular groove 728 in the interior surface. Rear conical ring 710 extends axially forward from first fold line 708 to second fold line 712. Second fold line 712 includes a triangular groove 740 on the exterior surface. Main cylindrical ring 714 extends axially forward from second fold line 712 to an interior edge 738 of annular attachment panel 716, which has fastener openings 718. Annual attachment panel 716 extends radially outward from main cylindrical ring 714 to outer annular edge 720 of annual attachment panel 716. Forward cylindrical ring 722 extends axially forward from outer annular edge 720 to third fold line 724. Third fold line 724 includes a triangular groove 802 (see FIG. 8) on an interior surface of foldable speaker baffle 702. Front conical ring 730 extends axially forward from third fold line 724 to front edge 726. The baseline configuration shown in FIG. 7A is a maximum axial length configuration. Annular attachment panel 716 separates front portion 734 of foldable speaker baffle 702 from rear portion 736 of foldable speaker baffle 702.

Auxiliary cutting lines 732 (one of two visible labeled of four total) extend axially long the external surfaces of rear ring 706, rear conical ring 710, and main cylindrical ring 714 and are preferably spaced apart circumferentially at ninety degree intervals. Auxiliary cutting lines 732 will be described further in regard to FIGS. 10-14.

FIG. 7B is a rear perspective view illustrating the second exemplary embodiment of the foldable speaker baffle 702 of FIG. 7A for the exemplary foldable speaker baffle system 100 of FIG. 1 in a first folded configuration, according to a preferred embodiment of the present invention. The exemplary first folded configuration has only the front portion 734 folded, with front conical ring 730 folded outward and rearward to cover forward cylindrical ring 722. The rear portion 736 of the foldable speaker baffle 702 is not folded in this configuration. FIGS. 7B-7E illustrate various folding configurations for respective various length requirements.

FIG. 7C is a rear perspective view illustrating the second exemplary embodiment of the foldable speaker baffle 702 of FIG. 7A for the exemplary foldable speaker baffle system 100 of FIG. 1 in a second folded configuration, according to a preferred embodiment of the present invention. The second folded configuration includes the rear ring 706 folded inward and forward along first fold line 708. The second folded configuration only has folds in the rear portion 736 of baffle 702.

Figure 7D:
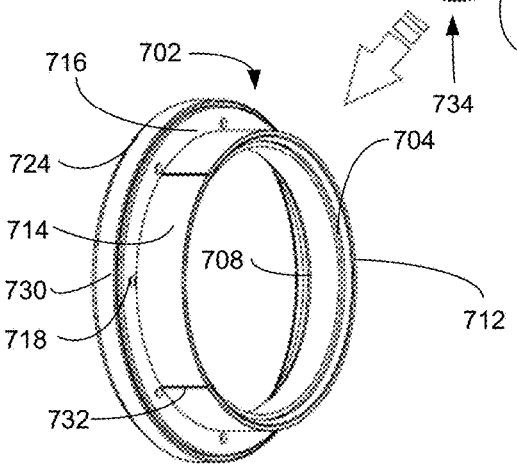
FIG. 7D is a rear perspective view illustrating the second exemplary embodiment of the baffle of FIG. 7A for the exemplary foldable speaker baffle system of FIG. 1 in a third folded configuration, according to a preferred embodiment of the present invention.

FIG. 7D is a rear perspective view illustrating the second exemplary embodiment of the foldable speaker baffle 702 of FIG. 7A for the exemplary foldable speaker baffle system 100 of FIG. 1 in an exemplary third folded configuration, according to a preferred embodiment of the present invention. In the third folded configuration, both the front portion 734 and the rear portion 736 of foldable speaker baffle 702 is folded. Rear ring 706 is pressed forward, forcing folds at first and second fold lines 708 and 712 in a radially accordion manner. The result has the exterior surface of rear ring 706 abutting the exterior surface of rear conical ring 710 and the internal surface of rear conical ring 710 abutting the internal surface of main cylindrical ring 714. The third folded configuration is a minimum axial length configuration.

Figure 7E:
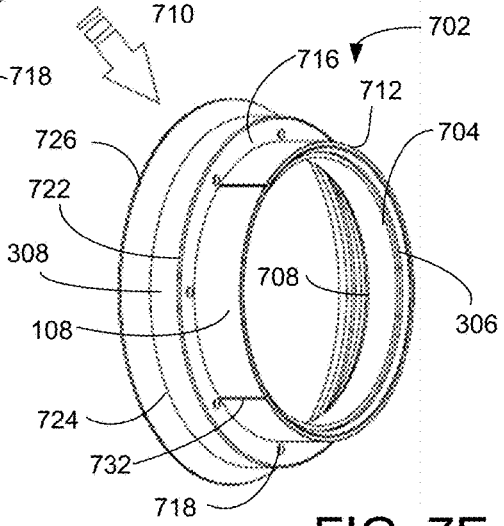
FIG. 7E is a rear perspective view illustrating the second exemplary embodiment of the baffle of FIG. 7A for the exemplary foldable speaker baffle system of FIG. 1 foldable speaker baffle system of FIG. 7A in a forth folded configuration, according to a preferred embodiment of the present invention.

FIG. 7E is a rear perspective view illustrating the second exemplary embodiment of the foldable speaker baffle 702 of FIG. 7A for the exemplary foldable speaker baffle system 100 of FIG. 1 in a fourth folded configuration, according to a preferred embodiment of the present invention. In the fourth folded configuration, the rear portion 736 is folded as in FIG. 7D and the front portion 734 is not folded.

Figure 8:
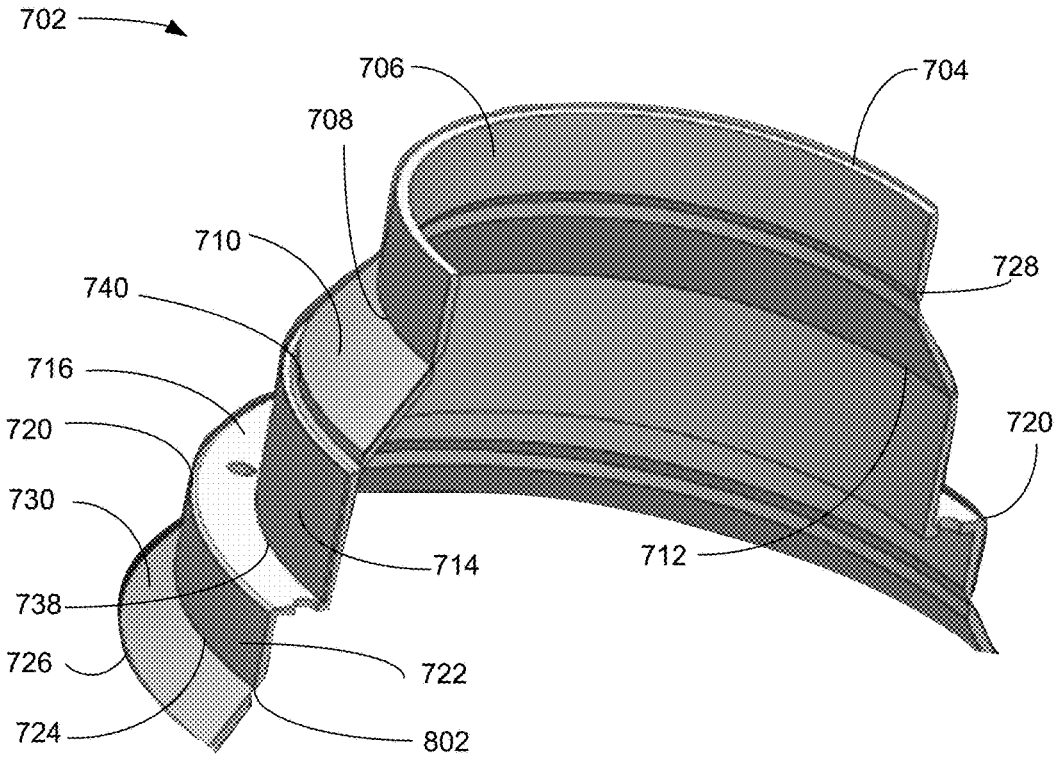
FIG. 8 is a cross sectional perspective view illustrating the second exemplary embodiment of the foldable speaker baffle of FIG. 7A for the exemplary foldable speaker baffle system of FIG. 1 in an unfolded configuration, according to a preferred embodiment of the present invention.

FIG. 8 is a cross sectional perspective view illustrating the second exemplary embodiment of the foldable speaker baffle 702 of FIG. 7A for the exemplary foldable speaker baffle system 100 of FIG. 1 in an unfolded configuration, according to a preferred embodiment of the present invention. The triangular grooves 728, 740, and 802 associated with fold lines 708, 712, and 724, respectively, are better seen in this view.

Figure 9:
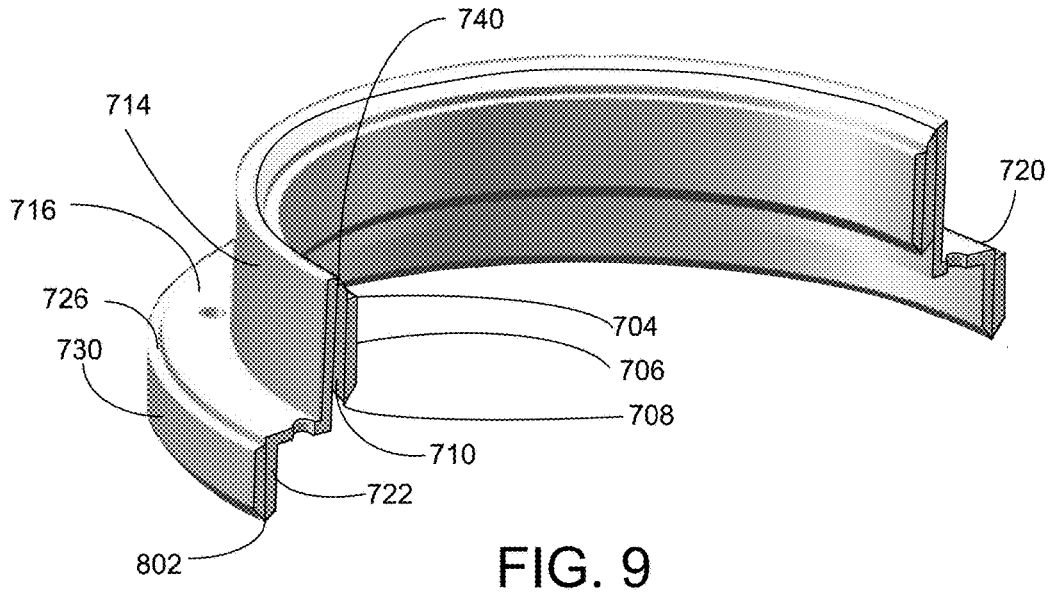
FIG. 9 is a cross sectional perspective view illustrating the second exemplary embodiment of the foldable speaker baffle of FIG. 7A for the exemplary foldable speaker baffle system of FIG. 1 in a fully folded configuration, according to a preferred embodiment of the present invention.

FIG. 9 is a cross sectional perspective view illustrating the second exemplary embodiment of the foldable speaker baffle 702 of FIG. 7A for the exemplary foldable speaker baffle system 100 of FIG. 1 in a fully folded configuration, according to a preferred embodiment of the present invention. The folding configuration of FIG. 7D can be more clearly seen in this view with rear ring 706 folded about first fold line 708 to abut against rear conical ring 710 which abuts main cylindrical ring 714. The folding of the rear portion 736 is a radial accordion fold. Likewise the folding configuration of front conical ring 730 folded about third fold line 724 to abut forward cylindrical ring 722 can be more clearly seen in this view.

Figure 10:
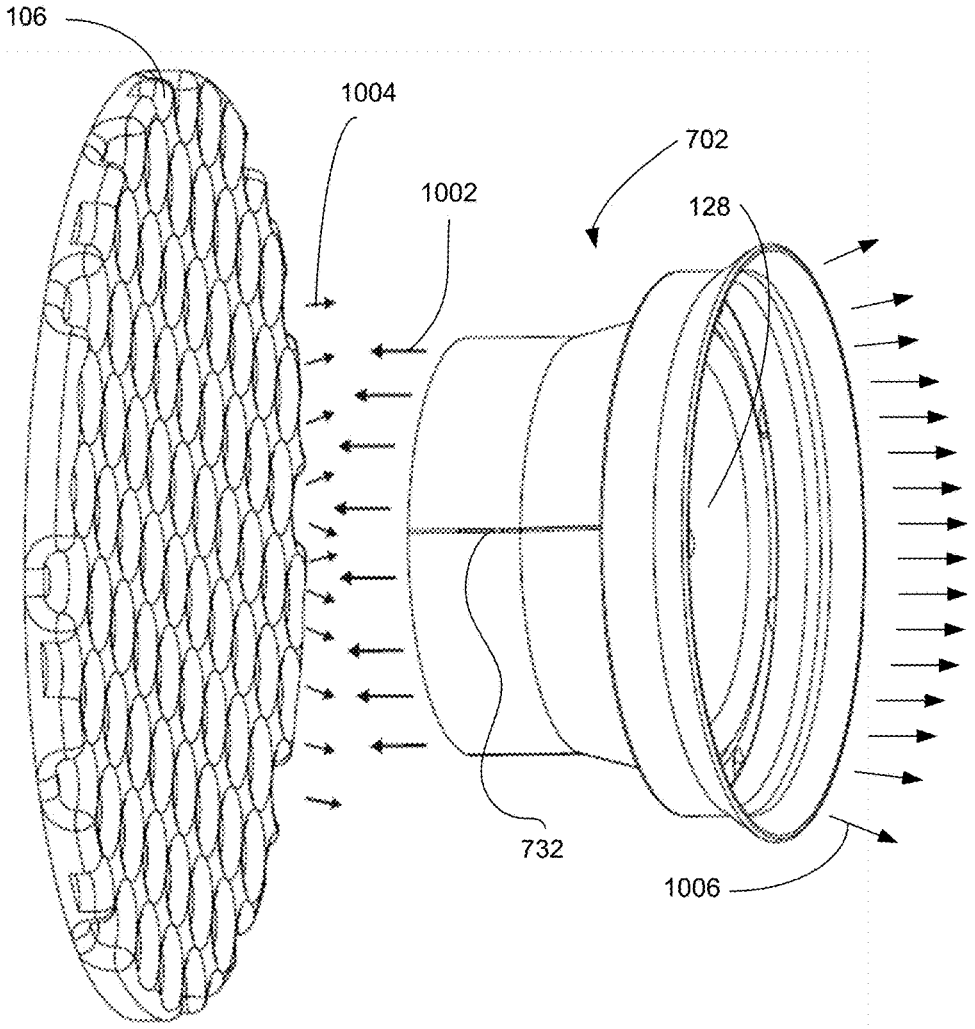
FIG. 10 is a side-front perspective view illustrating the second exemplary embodiment of the foldable speaker baffle of FIG. 7A for the exemplary foldable speaker baffle system of FIG. 1 in an uncut configuration, according to a preferred embodiment of the present invention.

FIG. 10 is a side-front perspective view illustrating the second exemplary embodiment of the foldable speaker baffle 702 of the foldable speaker baffle system 700 of FIG. 7A in an uncut configuration, according to a preferred embodiment of the present invention. In operation, the diaphragm 128 of speaker 130 moves rapidly and axially back and forth to send front sound wave 1006 out the front of speaker 130. With an open basket 124, back wave 1002 are also created exiting the rear of the speaker 130. Control of what happens with the back wave 1002 is a matter of interest to audiophiles. In the present invention, the back wave 1002 impinge upon sound dampening pad 106 and are diminished upon reflection 1004 of a dampened portion of the impinging back wave 1002. By shaping foldable speaker baffle 702 using a cutting tool and auxiliary cutting lines 732, the sound quality can be varied to suit a listener's preference. The annular attachment panel 716, gasket 104, speaker basket rim 120 and associated fasteners provide isolation between the back wave 1002 and the front sound wave 1006 off the front of the diaphragm 128. Gasket 104 is preferably made of a soft composite ethylene-vinyl acetate (EVA) material.

Figure 11:
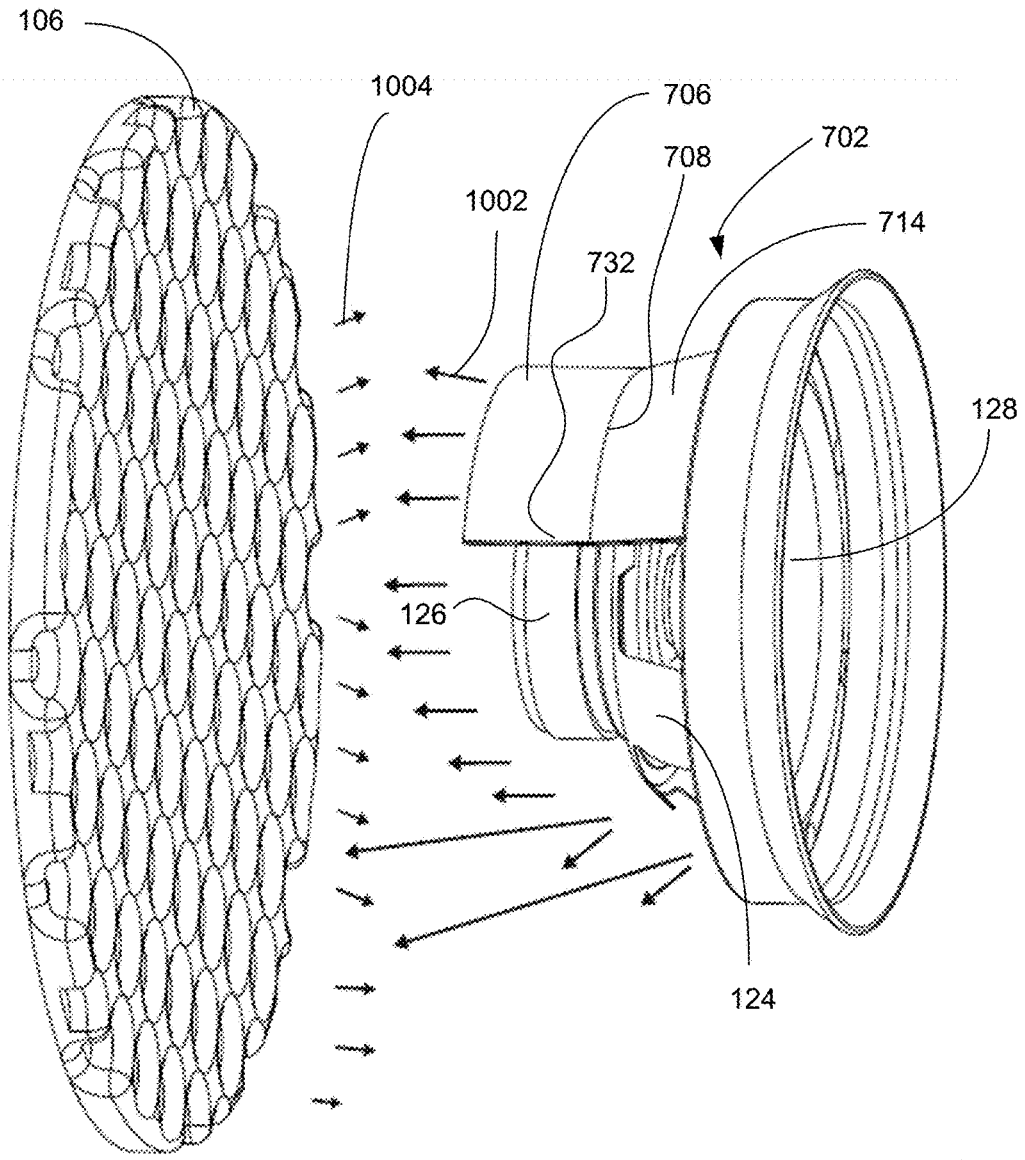
FIG. 11 is a side-front perspective view illustrating the second exemplary embodiment of the foldable speaker baffle of FIG. 7A for the exemplary foldable speaker baffle system of FIG. 1 in a first cut configuration, according to a preferred embodiment of the present invention.

FIG. 11 is a side-front perspective view illustrating the second exemplary embodiment of the foldable speaker baffle 702 of the foldable speaker baffle system 700 of FIG. 7A in a first cut configuration, according to a preferred embodiment of the present invention. The lower side half of rear ring 706 and rear conical ring 710 have been cut away along axillary cutting lines 732 and second fold line 712. In this configuration, foldable speaker baffle 702 still provides protection from water coming into the door from above, but reduces resistance to back wave 1002, thereby allowing the diaphragm 128 to move more freely and produce better sound. Cutting the folding speaker baffle 702 also helps to dissipate heat from the speaker 130.

Figure 12:
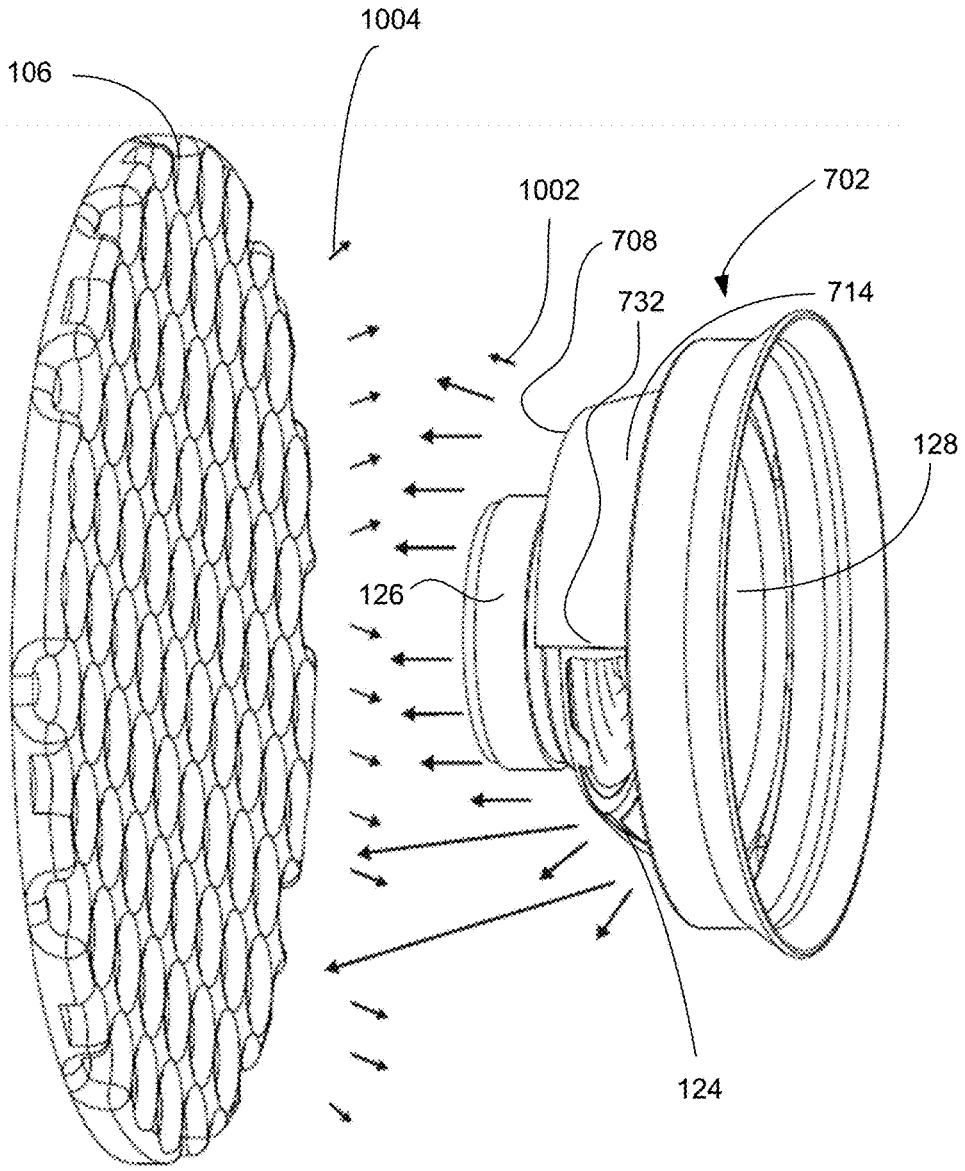
FIG. 12 is a side-front perspective view illustrating the second exemplary embodiment of the foldable speaker baffle of FIG. 7A for the exemplary foldable speaker baffle system of FIG. 1 in a second cut configuration, according to a preferred embodiment of the present invention.

FIG. 12 is a side-front perspective view illustrating the second exemplary embodiment of the foldable speaker baffle 702 of the foldable speaker baffle system 700 of FIG. 7A in a second cut configuration, according to a preferred embodiment of the present invention. In the second cut configuration, the rear ring 706 is removed and the lower side half of rear conical ring 710 has also been cut away. This configuration provides even less resistance to the back wave 1002 than the first cut configuration, but creates less protection against contaminants.

Figure 13:
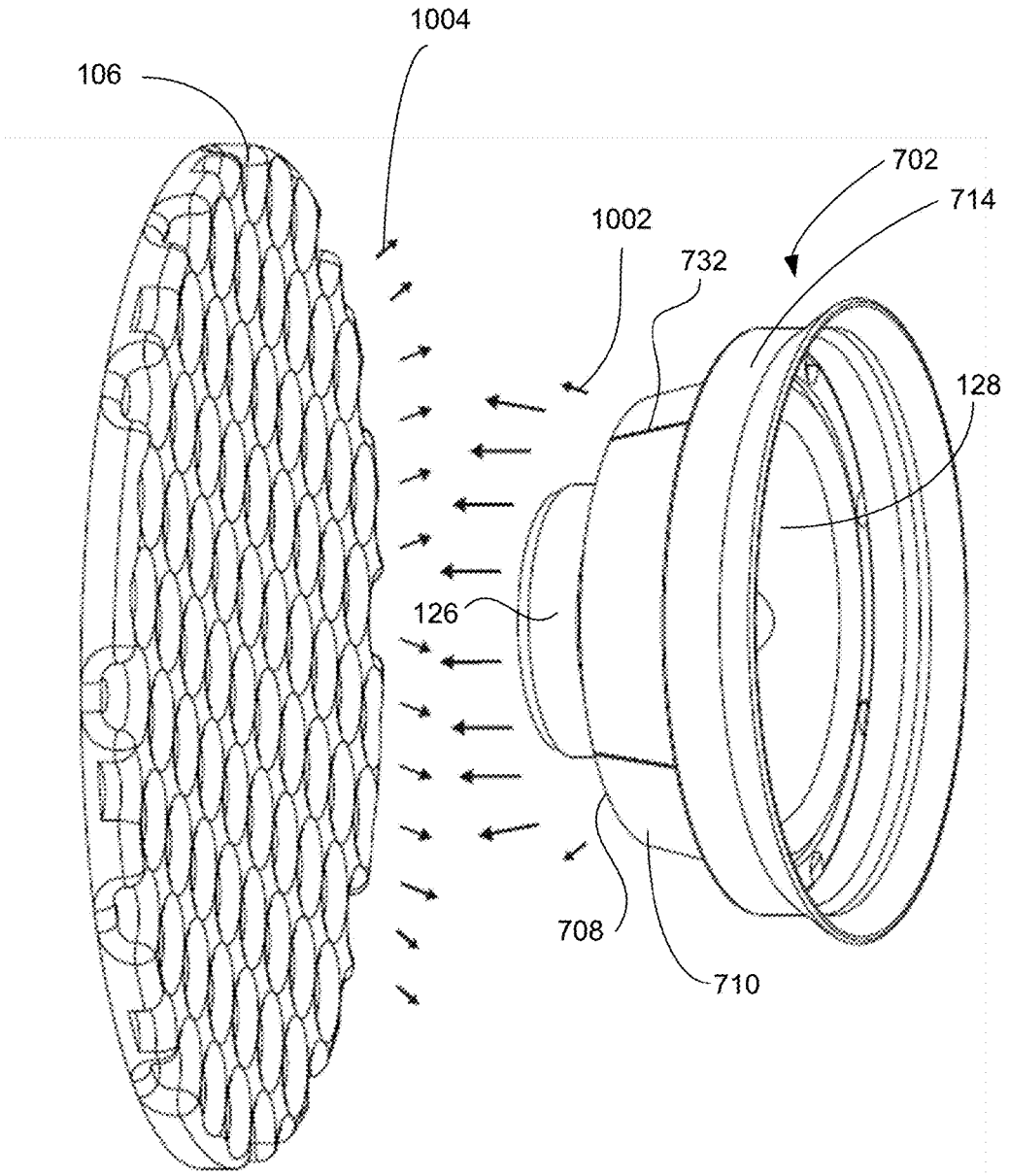
FIG. 13 is a side-front perspective view illustrating the second exemplary embodiment of the foldable speaker baffle of FIG. 7A for the exemplary foldable speaker baffle system of FIG. 1 in a third cut configuration, according to a preferred embodiment of the present invention.

FIG. 13 is a side-front perspective view illustrating the second exemplary embodiment of the foldable speaker baffle 702 of the foldable speaker baffle system 700 of FIG. 7A in a third cut configuration, according to a preferred embodiment of the present invention. In the third cut configuration, the rear ring 706 has been cut away along first fold line 708. This configuration provides an intermediate amount of resistance to the back wave 1002, as compared to the first and second cut configurations.

Figure 14:
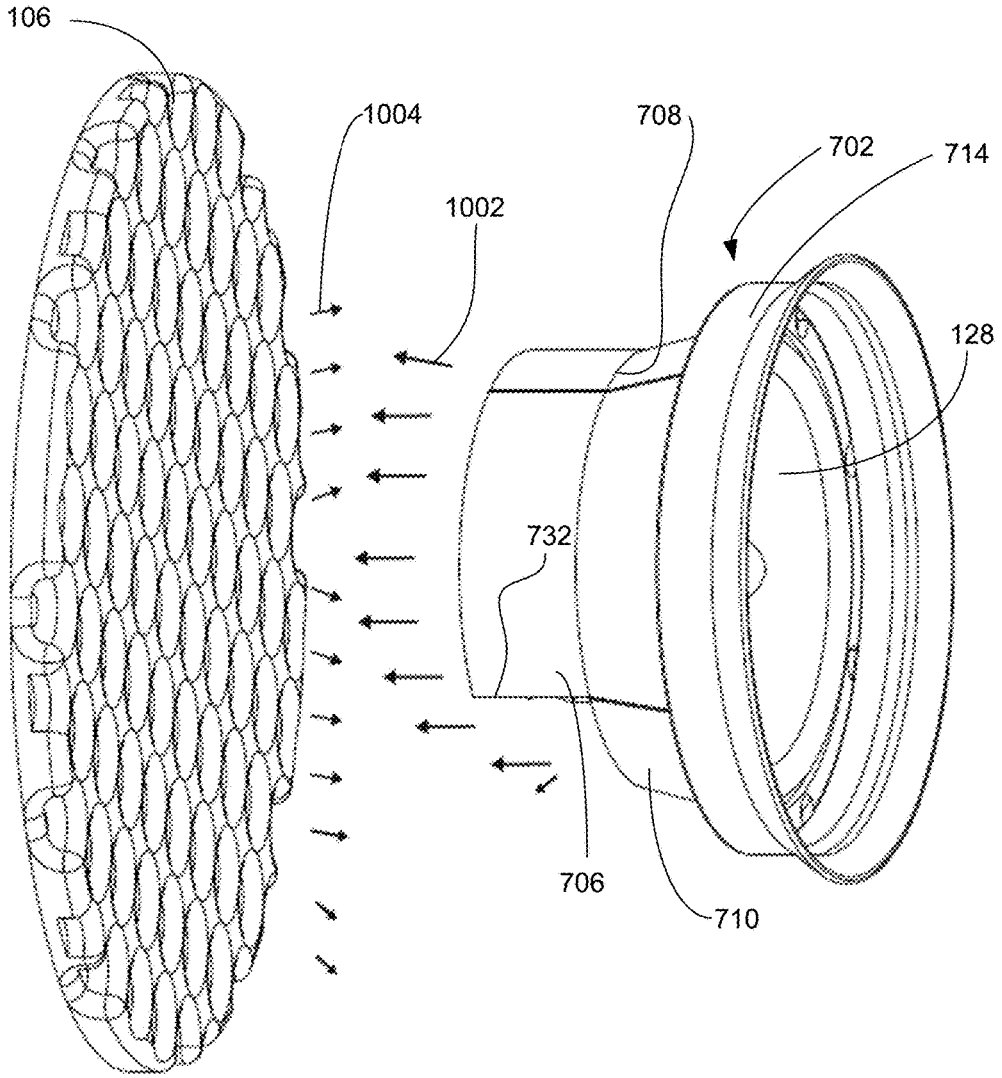
FIG. 14 is a side-front perspective view illustrating the second exemplary embodiment of the foldable speaker baffle of FIG. 7A for the exemplary foldable speaker baffle system of FIG. 1 in a fourth cut configuration, according to a preferred embodiment of the present invention.

FIG. 14 is a side-front perspective view illustrating the second exemplary embodiment of the foldable speaker baffle 702 of the foldable speaker baffle system 700 of FIG. 7A in a fourth cut configuration, according to a preferred embodiment of the present invention. In the fourth cut configuration, a bottom side portion of rear ring 706 has been cut away along auxiliary cutting lines 732 and first fold line 708. The fourth cut configuration provides good protection from contaminants from above and some reduced resistance to back wave 1002.

We claim:

1. A foldable speaker baffle system comprising:

a. a foldable speaker baffle comprising:
   i. one piece of foldable silicone rubber comprising a shell of revolution about a central axis; and
   ii. an annular attachment panel between a front foldable portion of said one piece of foldable silicone rubber and a rear independently foldable portion of said one piece of foldable silicone rubber;

b. a gasket corresponding to said annular attachment panel; and c. a sound dampening pad configured to receive a back wave from a speaker when installed in said foldable speaker baffle.

2. The foldable speaker baffle system of claim 1, wherein said foldable speaker baffle comprises a rear cylindrical ring extending axially rearward from a rear conical ring along a first circumferential fold line.

3. The foldable speaker baffle system of claim 1, wherein said foldable speaker baffle comprises a rear conical ring extending axially rearward from a main cylindrical ring along a second circumferential fold line.

4. The foldable speaker baffle system of claim 1, wherein said foldable speaker baffle comprises a main cylindrical ring extending axially rearward from an inner edge of an annular attachment panel.

5. The foldable speaker baffle system of claim 1, wherein said foldable speaker baffle comprises a front cylindrical ring extending axially forward from an outer edge of an annular attachment panel.

6. The foldable speaker baffle system of claim 1, wherein said foldable speaker baffle comprises a front conical ring extending axially forward from a front cylindrical ring along a third circumferential fold line.

7. The foldable speaker baffle system of claim 1, wherein said foldable speaker baffle comprises:

a. a first rear cylindrical ring extending axially rearward from a second rear cylindrical ring along a first circumferential fold line;

b. said second rear cylindrical ring extending axially rearward from a rear conical ring along a second circumferential fold line;

c. said rear conical ring extending axially rearward from an inner edge of an annular attachment panel;

d. a front cylindrical ring extending axially forward from an outer edge of said annular attachment panel;

e. a front conical ring extending axially forward from said front cylindrical ring along a third circumferential fold line; and f. wherein said first, second, and third circumferential fold lines each comprise a triangular groove on an interior or exterior surface of said foldable speaker baffle.

8. The foldable speaker baffle system of claim 1, wherein said foldable speaker baffle comprises a plurality of axial auxiliary cutting lines spaced apart on said rear portion of said foldable speaker baffle.

9. The foldable speaker baffle system of claim 1, wherein said sound dampening pad comprises an egg crate shaped front surface.

10. The foldable speaker baffle system of claim 1, comprising a plurality of circumferential fold lines, each having a triangular groove on an interior or exterior surface of said foldable speaker baffle.

11. The foldable speaker baffle system of claim 1, comprising a speaker installed in said foldable speaker baffle.

12. The foldable speaker baffle system of claim 1, comprising a radial accordion fold in said rear portion.

13. A foldable speaker baffle system comprising:

a. a foldable speaker baffle comprising:
   i. one piece of foldable silicone rubber formed as a shell of revolution about a central axis; and
   ii. an annular attachment panel between a front portion of said one piece of foldable silicone rubber and a rear portion of said one piece of foldable silicone rubber;

b. a gasket corresponding to said annular attachment panel;

c. a sound dampening pad for receiving a back wave from a speaker when installed in said foldable speaker baffle; and d. a plurality of circumferential fold lines, each having a triangular groove on an interior surface or exterior surface of said foldable speaker baffle.

14. The foldable speaker baffle system of claim 13, wherein said foldable speaker baffle comprises:

a. a rear cylindrical ring extending axially rearward from a conical ring along a first circumferential fold line;

b. said conical ring extending axially rearward from a main cylindrical ring along a second circumferential fold line;

c. said main cylindrical ring extending axially rearward from an annular attachment panel along an inner edge of said annular attachment panel;

d. a front cylindrical ring extending axially forward from an outer edge of said annular attachment panel; and e. a front conical ring extending axially forward from said front cylindrical ring along a third circumferential fold line.

15. The foldable speaker baffle system of claim 13, wherein said foldable speaker baffle comprises:

a. a first rear cylindrical ring extending axially rearward from a second rear cylindrical ring along a first circumferential fold line;

b. said second rear cylindrical ring extending axially rearward from a rear conical ring along a second circumferential fold line;

c. said rear conical ring extending axially rearward from an inner edge of an annular attachment panel;

d. a front cylindrical ring extending axially forward from an outer edge of said annular attachment panel;

e. a front conical ring extending axially forward from said front cylindrical ring along a third circumferential fold line;

f. wherein said first, second, and third circumferential fold lines each have a triangular groove on an interior or exterior surface of said foldable speaker baffle.

16. The foldable speaker baffle system of claim 14, wherein said first, said second, and said third circumferential fold lines each have a triangular groove on an interior or exterior surface of said foldable speaker baffle.

17. The foldable speaker baffle system of claim 13, comprising a speaker installed in said foldable speaker baffle.

18. The foldable speaker baffle system of claim 13, comprising a radial accordion fold in said rear portion.

19. A foldable speaker baffle system comprising:

a. a foldable speaker baffle comprising:

i. one piece of foldable silicone rubber formed as a shell of revolution about a central axis; and ii. an annular attachment panel between a front portion of said one piece of foldable silicone rubber and a rear portion of said one piece of foldable silicone rubber;

b. a gasket corresponding to said annular attachment panel;

c. a sound dampening pad having an egg crate shaped surface for receiving a back wave from a speaker when installed in said foldable speaker baffle;

d. wherein said foldable speaker baffle further comprises:

i. a rear cylindrical ring extending axially rearward from a conical ring along a first circumferential fold line;

ii. said conical ring extending axially rearward from a main cylindrical ring along a second circumferential fold line;

iii. said main cylindrical ring extending axially rearward from an annular attachment panel along an inner edge of said annular attachment panel;

iv. a front cylindrical ring extending axially forward from an outer edge of said annular attachment panel; and v. a front conical ring extending axially forward from a front cylindrical ring along a third circumferential fold line; and vi. wherein said first, second, third, and fourth fold lines, each have a triangular groove on an interior or exterior surface of said foldable speaker baffle.

20. The foldable speaker baffle system of claim 19, comprising: at least one of:

a. a speaker installed in said foldable speaker baffle;

b. a radial accordion fold in said rear portion; and c. a combination of:

i. a first rear cylindrical ring extending axially rearward from a second rear cylindrical ring along a first circumferential fold line;

ii. said second rear cylindrical ring extending axially rearward from a rear conical ring along a second circumferential fold line;

iii. said rear conical ring extending axially rearward from an inner edge of an annular attachment panel;

iv. a front cylindrical ring extending axially forward from an outer edge of said annular attachment panel;

v. a front conical ring extending axially forward from said front cylindrical ring along a third circumferential fold line;

vi. wherein said first, second, and third circumferential fold lines each have a triangular groove on an interior or exterior surface of said foldable speaker baffle.

* * * * *